US006179286B1

(12) United States Patent
Bennett

(10) Patent No.: US 6,179,286 B1
(45) Date of Patent: Jan. 30, 2001

(54) SHEET RECEIVING AND STACKING APPARATUS AND METHOD

(75) Inventor: Bryson Bennett, Westminster, CA (US)

(73) Assignee: Gradco (Japan) Ltd., Tokyo (JP)

( * ) Notice: Under 35 U.S.C. 154(b), the term of this patent shall be extended for 0 days.

(21) Appl. No.: 09/468,131

(22) Filed: Dec. 21, 1999

(51) Int. Cl.[7] ..... B65H 31/08
(52) U.S. Cl. ..... 271/212
(58) Field of Search ..... 271/212

(56) References Cited

U.S. PATENT DOCUMENTS 4,808,054 * 2/1989 Cuzin ..... 271/212 X
5,364,089 * 11/1994 Manzer ..... 271/212 X

FOREIGN PATENT DOCUMENTS

2229531 * 2/1973 (DE) ..... 271/212
2107686 * 5/1973 (DE) ..... 271/212

* cited by examiner

*Primary Examiner*—David H. Bollinger
(74) *Attorney, Agent, or Firm*—Newton H. Lee, Jr.

(57) ABSTRACT

A sheet receiving and stacking apparatus has an infeed tray to which sheets are sequentially fed with their printed side facing upwardly starting in order, sheet one to the last sheet of a set or job, and continuing through the last sheet of the set or job, the trailing end of successive sheets being elevated and progressively moved upwardly to form a stack of sheets commencing with the first fed sheet with the last fed sheet of a set or job at the bottom and stacked on an upper run of a sheet elevating device which provides a stacker for stacking sets or jobs in sequential order with the first fed sheet of each set or job on top.

The method of receiving sheets fed sequentially from a printer or copier with an upper printed surface, including the steps of: establishing a sheet infeed location extending horizontally, moving the leading end of successive sheets progressively beneath the previous sheet, while progressively raising the trailing end of successive previous sheets, and stacking a group of said sheets with the printed surfaces facing upwardly in the order fed above said infeed location.

2 Claims, 3 Drawing Sheets

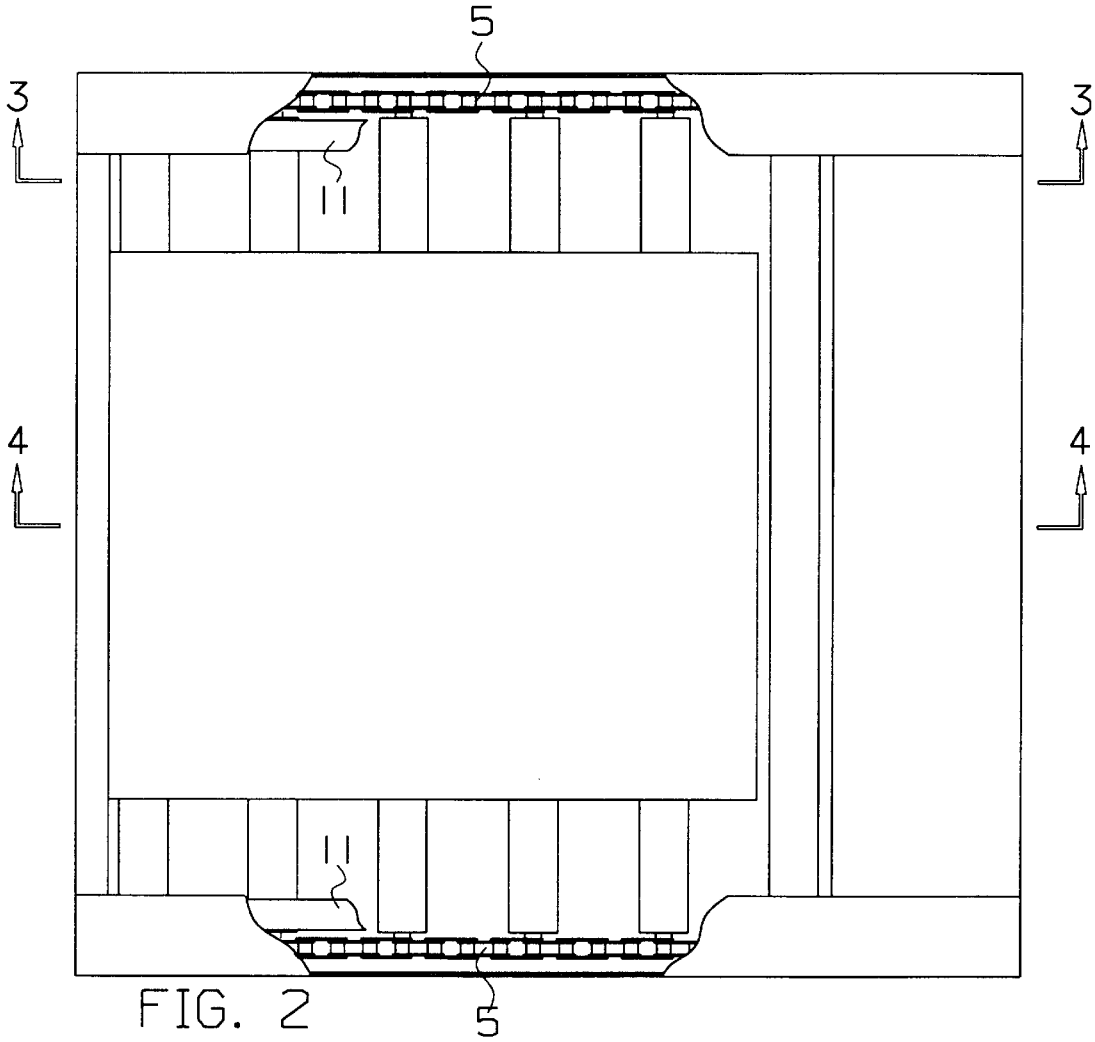
FIG. 2
FIG. 3
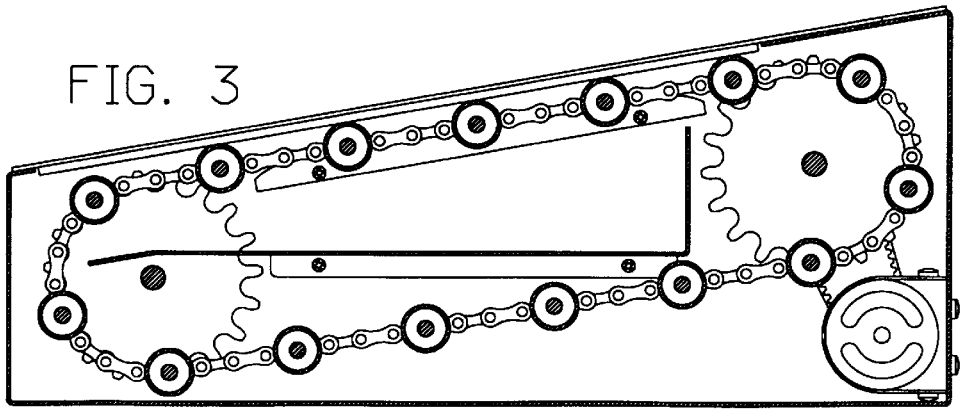

SHEET RECEIVING AND STACKING APPARATUS AND METHOD

BACKGROUND OF THE INVENTION

In the processing of sets or jobs fed from a copying or printing machine for stacking or post processing, it is a common procedure in the case of machines which feed the sheets from a printer or copier with the printed side of the sheet facing upwardly, to employ an inverter, so that as the sheets are fed from the printer or copier to the stacking or post processing machines the sheets are stacked in the correct order, printed side down.

The use of a sheet inverter between the stacker or the post processing machine causes a delay in the continuous feeding of the sheets so that inversion of sheets in a sheet inverter limits the upper range of the speed of the sheet delivery without causing a delay in the operation of the sheet printing or copying machine output. On the other hand, inversion of the sheets being fed face up makes necessary the inversion in order to properly stack the sheets from the first to the last sheet of the set or job.

An example of inversion is seen in U.S. patent application Ser. No. 356,656, filed Jul. 19, 1999, co-owned herewith and to which reference may be had. In this apparatus the first sheet fed thereto is stopped at a staging station at which the second fed sheet is positioned beneath the first fed sheet, and then the two sheets are fed together to a receiving station at which the sheets are inverted to first sheet beneath the second and subsequent sheets in order.

SUMMARY OF THE INVENTION

An object of the present invention is to provide an apparatus which substantially permits the continuous feeding of sheets from a printer or copier operating at low speed, but, as well as at relatively fast output speeds, say, up to 100 and above sheets per minute, wherein the printer or copier feeds the sheets from first to the end with the printed side facing upwardly but wherein the sheets are stacked first to last in order so that the first sheet is on the top of the stack and the last sheet is on the bottom of the stack representing a set or job in the order fed.

Another object is to provide a method involving receiving the sheets at a horizontal stacker continuously from a printer or copier with an upper printed surface, including the steps of moving the leading end of successive sheets progressively beneath the previous sheets, elevating the trailing end of successive sheets, and stacking a group of said sheets with the printed surfaces facing in the order fed.

In accomplishing the foregoing the sheets are fed from a printer or copier into a receiving tray on which an intermittently driven set of rollers on a conveyor are caused to lift the trailing edge of the sheet and then the rollers progressively elevate the sheet from the trailing end to the leading end so that the sheet is, without inversion, fully elevated to the top run of the conveyor to form a stack of sheets in the order fed.

With such a construction, the speed of the output of sheets from the printer or copier is reasonably irrelevant over a low range or a relatively high range or rate of sheets per minute fed from the source machine and substantially no inter-copy gap or inter-set slow down of the source machine is required such as for the purpose of allowing the sheets to be inverted.

More specifically, the rollers are caused to rotate in the opposite direction from their direction of movement of the conveyor so as to assist in maintaining the sheets in a slightly downward disposition and so as to assure trailing end registration or precise registration against a backstop which may be provided either by the vertical face of the copier or printer or separately.

Furthermore, if desired, the device may be provided with means for offsetting the sheets while they are being gathered into sets or jobs, so that finished sets or jobs are correspondingly offset by offsetting mechanism well known in the art, but not shown in this application.

Other objects and advantages of the invention will be recognized by those skilled in the art by reference to the attached drawings or will be described in the specification.

BRIEF DESCRIPTION OF THE DRAWINGS

FIG. 2 is a top plan of the apparatus of the invention showing sheet on top of the apparatus;

FIG. 3 is a vertical section as taken on the line 3—3 of FIG. 2;

DESCRIPTION OF THE PREFERRED EMBODIMENT

Figure 1:
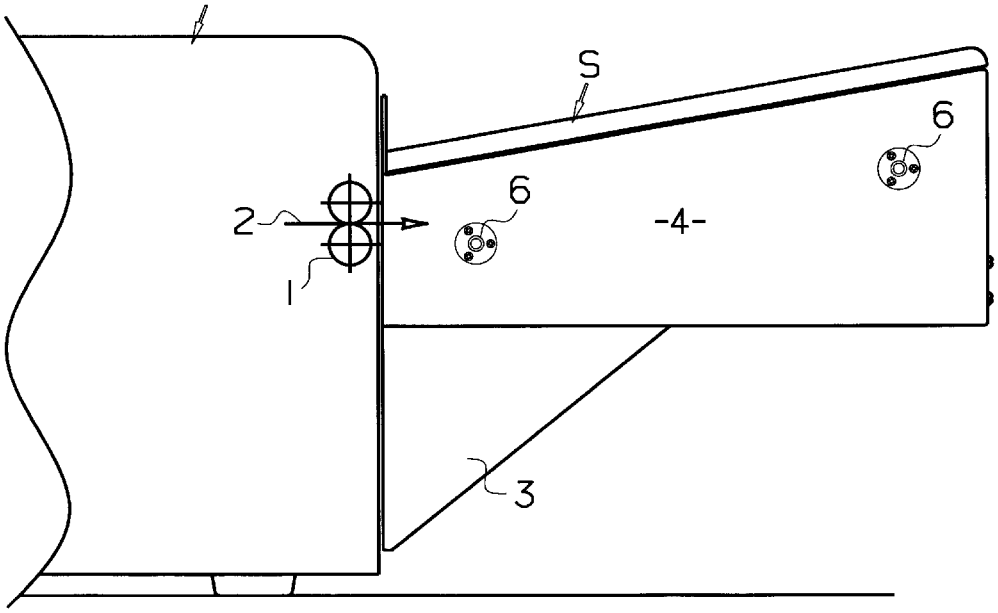
FIG. 1 is a side elevation showing the apparatus of the invention applied to a source such as a printing or copying machine to receive sheets therefrom.

Referring to FIG. 1, a fragmentary source machine such as a printing or copying machine is shown at M having output rolls 1 adapted to sequentially feed sheets in the direction of the arrow 2 into the stack forming apparatus S of the present invention which is shown as suitably supported by one or more braces 3 or on a shelf in a suitable position with respect to the printing or copying machine M.

Figure 4:
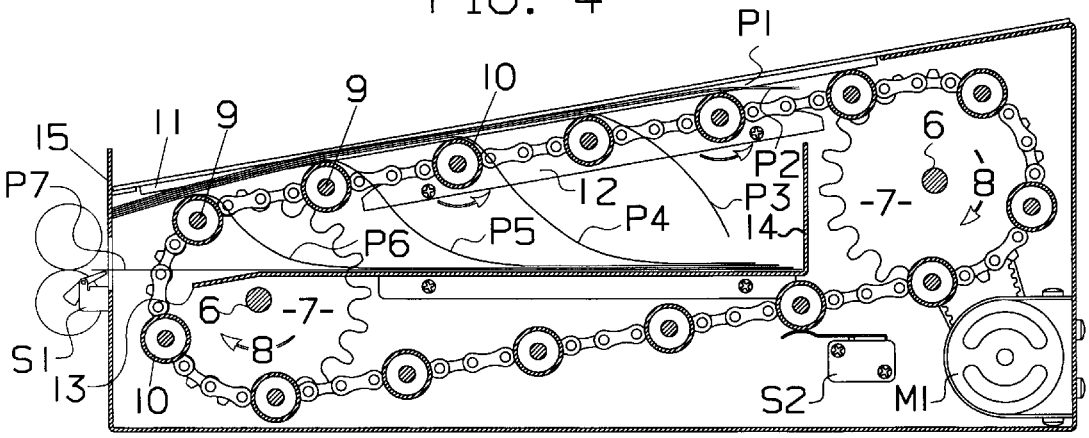
FIG. 4 is a vertical section as taken on the line 4—4 of FIG. 2 showing a stage in the formation of a subsequent job or set.

The stack forming machine S includes a box like structure 4 having side walls and, as seen in FIGS. 2 and 4, an inclined top portion inclined slightly downwardly towards the source machine M.

Internally, the stack forming apparatus has a pair of laterally spaced continuous drive belts or chains 5 at opposite sides and supported on transverse shafts 6 on which sprockets 7 are mounted for rotation in the direction indicated by the arrows 8. Each chain carries in a horizontally extended spaced position a plurality of shafts 9 about which rolls 10 are rotatably disposed for movement in upper and lower runs.

Each roll 10, in the upper run of the rollers, is engaged along the upper sides thereof with means 11 for causing the rolls to rotate in the opposite direction, as shown by the arrows, from their direction of horizontal movement by the drive sprockets. As shown, this means 11 is simply a strip of resilient material extending substantially along the edge of the traveling chains 5 in frictional engagement with the rolls 10 or other equivalent means to effect rotation.

Below the upper run is a pair of rails 12 for resiliently holding the rolls against the strips 11. These rails 12 are also adapted to support the weight of all sets of paper above the rolls. Other means may be employed to equivalently cause roll rotation.

Between the upper and lower runs of the conveyor chains is a horizontally extended sheet receiving tray 13 having an internal vertical end wall 14 at its inner end. Sheets fed into the apparatus S move along the tray 13 and are stopped by the vertical wall 14.

Figure 5:
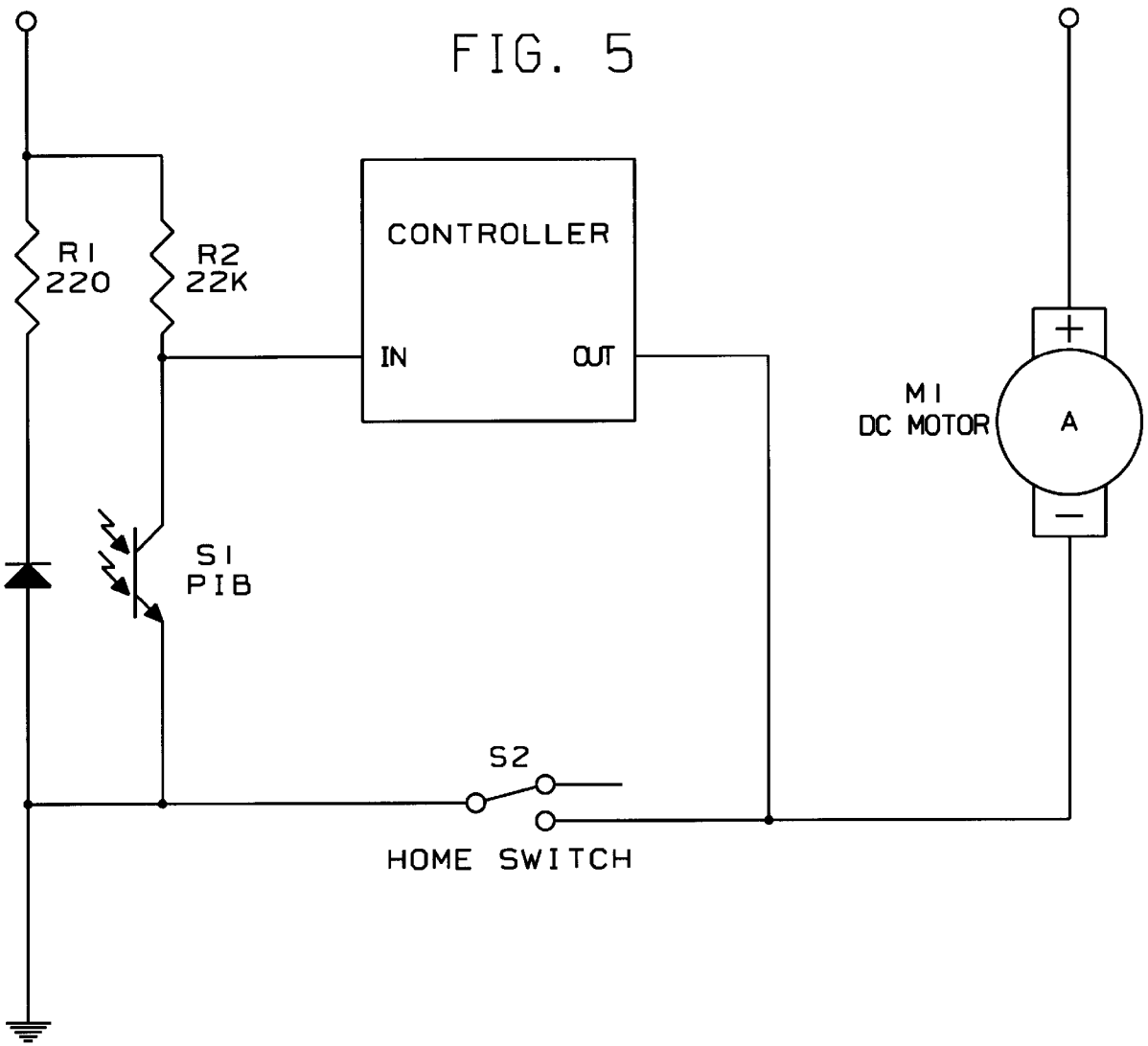
FIG. 5 is a diagram of a control system for the apparatus.

A drive motor M1 is shown for driving the sprockets 7 in a clockwise direction under control of switches S1 and S2, shown in FIG. 4, and a CONTROLLER as seen in FIG. 5.

Switch S1 is a paper in bin switch or PIB which detects the feed of a sheet or successive sheets into the tray 13. So long as the switch S1 is closed, power is directed to the CONTROLLER at "IN" and from the CONTROLLER to energize or deenergize motor M1. Under instructions from the CONTROLLER, the motor M1 is caused to drive the roller successively to the switch S2 which is a home switch which when activated by the successive rollers will cause instantaneous stopping of the motor drive for the brief period required for entry of the next sheet beneath the trailing end of the previous sheet during the instant that is required for movement of the drive to stop before the PIB switch 51 recognzies the incoming successive sheet.

Under instruction from the CONTROLLER, the movement of the drive will be timed to the infeed rate of the supply of sheets. The CONTROLLER will be set by the sheet infeed speed to the apparatus of the invention from the infeed machine M over a wide range of sheet infeed speeds.

The operation of the stacking apparatus in the performance of the method of the invention is quite simple. The trailing end of a sheet resting on tray 13 is lifted by the oncoming rollers 10 as they move upwardly from the lower run from the P7 position of FIG. 4. Sheets P1 through P6 have been previously lifted at their trailing end and have been progressively moved by rollers 10 from the tray upwardly to a position above the rollers 10 to the position indicated at P1, at which the first page of a set of printed material in a face up condition is successively followed by P2, P3, P4, P5, P6 and P7 so as to produce a set or job of 7 sheets. On the other hand, continued upward movement of trailing ends and progressive continued upward movement or elevation of successive sheets of the same set or job will simply add to the thickness of the stack of sheets being formed, as a set or sets are successively stacked one on the other first set or job on the last set or job, with the printed matter facing upwardly in each set.

Reverse rotation of the rollers 10 will cause downward movement of the sheets into engagement with stop wall 14 to assist in trailing end alignment.

As previously indicated, by offsetting the successive sets or jobs, the distinction may be better maintained to allow for ease of removal or set separation.

Various post processing machines or devices may be employed, if desired, for performing a post processing function, such as stapling or the like.

While specific details of a demonstration model of the receiving and stacking apparatus have been illustrated it will be recognized that the structural elements, including the chains and rolls and the like, may comprise materials and constructions whereby the endless path of the rollers can be made relatively smooth and quiet. It is the purpose of the illustrated embodiment to represent primarily the inventive concept in its present state of evolution and variation of arrangement and construction are intended to be covered by the following claims.

What is claimed is:

1. A sheet receiving and stacking apparatus including: an infeed for receiving sheets sequentially fed thereto with the printed sides facing upwardly, means for vertically elevating the trailing end of successive sheets and progressively moving the successive sheets upwardly to form a stack of fed sheets with the first fed sheet and all successive sheets of the stack on top with the printed sides facing upwardly, wherein said means includes a set of endlessly arranged rollers, having upper and lower runs, and said infeed includes a tray between said runs for supporting successively fed sheets thereon with the trailing end of each sheet disposed for engagement by a roller moving from said lower run towards said upper run, and including means for rotating the rollers of said upper run in a direction tending to reverse movement of the sheet in contact with the top of said upper rollers.

2. A sheet receiving and stacking apparatus including: an infeed for receiving sheets sequentially fed thereto with the printed sides facing upwardly, means for vertically elevating the trailing end of successive sheets and progressively moving the successive sheets upwardly to form a stack of fed sheets with the first fed sheet and all successive sheets of the stack on top with the printed sides facing upwardly, wherein said means includes a set of endlessly arranged rollers, having upper and lower runs, and said infeed includes a tray between said runs for supporting successively fed sheets thereon with the trailing end of each sheet disposed for engagement by a roller moving from said lower run towards said upper run wherein said upper run is sloped downwardly and oppositely to the direction of infeed of sheets, and including a stop wall for aligning the edges of sheets moving down said upper run.

* * * * *